US009546414B2

(12) United States Patent
Izquierdo et al.

(10) Patent No.: US 9,546,414 B2
(45) Date of Patent: Jan. 17, 2017

(54) WIRE-TYPE SPRAY MATERIAL FOR A THERMALLY SPRAYED LAYER HAVING A PEARLITE, BAINITE, MARTENSITE STRUCTURE

(75) Inventors: Patrick Izquierdo, Ulm (DE); Eyuep Akin Oezdeniz, Walheim am Neckar (DE)

(73) Assignee: Daimler AG, Stuttgart (DE)

( * ) Notice: Subject to any disclaimer, the term of this patent is extended or adjusted under 35 U.S.C. 154(b) by 112 days.

(21) Appl. No.: 13/980,919

(22) PCT Filed: Dec. 7, 2011

(86) PCT No.: PCT/EP2011/006130

§ 371 (c)(1),
(2), (4) Date: Jul. 24, 2013

(87) PCT Pub. No.: WO2012/100798

PCT Pub. Date: Aug. 2, 2012

(65) Prior Publication Data

US 2013/0295412 A1 Nov. 7, 2013

(30) Foreign Application Priority Data

Jan. 26, 2011 (DE) ..... 10 2011 009 443

(51) Int. Cl.

| | |
|---|---|
| ***C22C 38/42*** | (2006.01) |
| ***C23C 30/00*** | (2006.01) |
| ***C22C 38/20*** | (2006.01) |
| ***B32B 15/01*** | (2006.01) |
| ***C22C 38/22*** | (2006.01) |
| ***C22C 38/24*** | (2006.01) |

(52) U.S. Cl.

CPC ..... *C22C 38/42* (2013.01); *C22C 38/20* (2013.01); *C22C 38/22* (2013.01); *C22C 38/24* (2013.01); *C23C 4/131* (2016.01); *C23C 30/00* (2013.01); *Y10T 428/12972* (2015.01)

(58) Field of Classification Search

CPC ..... B32B 15/01
USPC ..... 428/677; 420/8–129
See application file for complete search history.

(56) References Cited

U.S. PATENT DOCUMENTS

| | | | | |
|---|---|---|---|---|
| 5,592,927 | A | 1/1997 | Zaluzec et al. | |
| 2004/0129354 | A1* | 7/2004 | Nagao et al. | 148/598 |
| 2006/0165552 | A1* | 7/2006 | Kapoor et al. | 420/70 |

(Continued)

FOREIGN PATENT DOCUMENTS

| | | | | |
|---|---|---|---|---|
| DE | 10308563 | B3 | 8/2004 | |
| DE | 102008034547 | * | 7/2008 | C23C 4/06 |

(Continued)

OTHER PUBLICATIONS

English Machine Translation of DE102008034547, EPO, Accessed Dec. 9, 2014.*

*Primary Examiner* — Humera Sheikh
*Assistant Examiner* — Lucas Wang
(74) *Attorney, Agent, or Firm* — Patent Central LLC; Stephan A. Pendorf

(57) ABSTRACT

A wire-form spray material, in particular for arc wire spraying, essentially comprising iron. The spray material is formed at least with carbon as a microalloy such that upon solidification of the spray material a fine pearlitic, bainitic, martensitic structure arises in which finely dispersed nitrides are present.

5 Claims, 1 Drawing Sheet

(56) References Cited

U.S. PATENT DOCUMENTS

| | | | | |
|---|---|---|---|---|
| 2007/0277913 | A1* | 12/2007 | Kochi et al. | 148/598 |
| 2009/0065105 | A1* | 3/2009 | Kochi et al. | 148/580 |
| 2009/0223610 | A1* | 9/2009 | Kochi et al. | 148/645 |
| 2009/0277539 | A1* | 11/2009 | Kimura et al. | 148/504 |
| 2010/0003540 | A1* | 1/2010 | Koseki | B21B 1/38<br>428/638 |

FOREIGN PATENT DOCUMENTS

| | | | | |
|---|---|---|---|---|
| DE | 202009001002 | U1 | 4/2009 | |
| DE | 102008034549 | B3 | 10/2009 | |
| DE | 102008034551 | B3 | 10/2009 | |
| DE | 102008034547 | B3 | 2/2010 | |
| DE | 102009039453 | A1 | 8/2010 | |
| EP | 0330752 | * | 9/1989 | B23D 61/185 |
| JP | 2004-124236 | * | 4/2004 | C22C 38/00 |

* cited by examiner

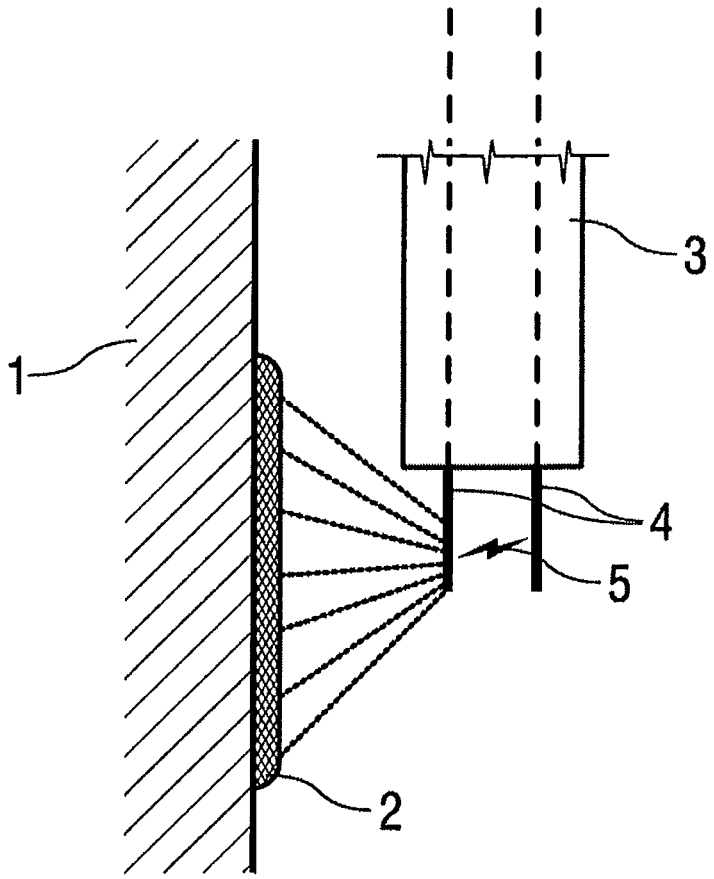
1
2
3
4
5

WIRE-TYPE SPRAY MATERIAL FOR A THERMALLY SPRAYED LAYER HAVING A PEARLITE, BAINITE, MARTENSITE STRUCTURE

The invention relates to a wire-form spray material, in particular for arc wire spraying, essentially comprising iron and a thermal sprayed coating, which is deposited on a substrate.

In the production of internal combustion engines, minimal friction and high resistance to abrasion and wear are sought for the sake of energy efficiency and reduction of emissions. To this end, engine components such as cylinder bores or the walls thereof are provided with a contact surface or else liners are inserted in the cylinder bores, which are provided with a contact surface. The application of such contact surfaces is generally achieved by thermal spraying, for example arc wire spraying. In arc wire spraying, an electric arc is generated between two wire-form spray materials by applying a voltage. The wire tips thus melt off and are conveyed by means of, e.g., an atomizing gas to the surface being coated, e.g., the cylinder wall, where they form a deposit.

DE 103 08 563 B3 discloses a cylinder liner for internal combustion engines, comprising a base body with a wear-resistant coating on the contact surface based on a hard iron alloy with carbon and oxygen, wherein the wear-resistant layer has martensitic phases and forms oxides and wherein said wear-resistant layer can be applied by arc wire spraying and the alloy of the coating has a carbon content of 0.5 to 3 wt %.

DE 10 2008 034 547 B3 discloses wire-form spray material for an iron-based thermal sprayed coating with a bainitic, martensitic structure, which has a carbon content of 0.23 wt % to 0.4 wt % as well as a chromium content of 0.75 wt % to 0.95 wt % and other alloy components.

DE 10 2008 034 547 B3 discloses wire-form spray material for an iron-based thermal sprayed coating with a pearlitic, bainitic, martensitic structure, which has a carbon content of 0.45 wt % to 0.55 wt % as well as a copper content of 0.25 wt % to 0.35 wt % and other alloy components.

DE 10 2008 034 551 B3 discloses wire-form spray material for an iron-based thermal sprayed coating with a bainitic, martensitic structure, which has a carbon content of 0.35 wt % to 0.55 wt % as well as a copper content of 0.25 wt % to 0.35 wt % and other alloy components.

DE 10 2009 039 453 A1 and DE 20 2009 001 002 U1 disclose wire-form spray material for an iron-based thermal sprayed coating with a pearlitic, bainitic, martensitic structure, which has a carbon content of 0.1 wt % to 0.28 wt % as well as a silicon content of 0.05 wt % to 0.3 wt % and other alloy components.

An object of the invention is to propose an economical, improved wire-form spray material, in particular for arc wire spraying. When defining the specifications of the wire-form spray material, along with the coating properties the spray behavior of said wire-form spray material and the machinability of the spray coating are influenced in a targeted manner.

Another object of the invention is to present a dense, tribologically improved spray coating, in particular one that can be deposited on a substrate by arc wire spraying and effectively machined.

According to the invention, the object is achieved by a wire-form spray material with the features of claim 1.

Advantageous developments are the subject matter of the subordinate claims.

A wire-form spray material of the invention, in particular for arc wire spraying, essentially comprises iron. The spray material is formed at least with carbon as a microalloy such that upon solidification of the spray material at least pearlite and bainite are produced, wherein additional provision is made of microalloy elements for forming wear-resistant phases and for improving the tribologic properties.

Microalloys are alloys that are formed predominantly from one component, to which only small quantities of other components are added in proportion to a total weight. Fine-grained pearlite consisting of hard Fe3C and ferrite is a tribologically positively effective phase. Bainite is a transformation phase of medium hardness and wear resistance. Martensite is a hard, wear-resistant structure. The formation of martensite can be influenced in a targeted manner by the type of cooling of the spray material and by the selection of the alloy components of the microalloy.

The ratio of bainite to pearlite can likewise be influenced in a targeted manner by the type of cooling of the spray material and by the selection of the alloy components of the microalloy.

A coating on a substrate such as a cylinder contact surface created by depositing the spray material of the invention by arc wire spraying comprises pearlite and bainite as well as wear-resistant islands of martensite.

Tribologically effective phases are useful for improving the operating performance in critical system states such that excessive wear of the friction partners or damage thereto due to adhesive reactions is avoided when, for example, lubricating films tear off. These states arise in particular in mixed friction ranges on, for example, top dead centers and bottom dead centers in cylinder contact surface/piston ring tribological systems.

An exemplary embodiment of the invention is described in more detail in the following, with reference to a drawing.

Shown is:

FIG. 1 a substrate with a coating deposited by arc wire spraying.

FIG. 1 shows a substrate 1 with a coating 2 deposited by arc wire spraying. In arc wire spraying, two wire-form spray materials 4 are fed into a coating head 3. An electric arc 5 is struck between the wire-form spray materials 4. The wire-form spray material 4 melts and is deposited in a targeted manner on the substrate 1 to be coated by means of a carrier gas, where it cools, solidifies, and forms the coating 2.

The wire-form spray material 4 essentially comprises iron. The spray material is formed with at least carbon as a microalloy such that pearlite and bainite are formed upon solidification of the spray material. Also provided in the microalloy are alloy components for the formation of wear-resistant phases out of martensite and for friction coefficient reduction.

Provision is made of the following alloy components:

carbon 0.28 wt % to 0.6 wt %,
silicon 0.6 wt % to 0.8 wt %,
manganese 1.0 wt % to 1.4 wt %,
chromium 0.05 to 0.35 wt %,
copper 0.04 wt % to 0.15 wt %,
nitrogen 0.005 to 0.03 wt %

Unless stated otherwise, the quantities are listed as percent by weight, in each case based on a total weight.

The elements vanadium, molybdenum, phosphorus, sulfur and aluminum and nickel are preferably contained at least in traces, i.e., in fractions of at least 0.001 wt %.

Preference is given to maximum contents of 0.15 wt % for vanadium, 0.1 wt % for nickel, 0.03 wt % for molybdenum, and 0.01 wt % for the other elements mentioned.

According to a first exemplary embodiment, preference is given to the use of a microalloy with the following components for the wire-form spray material:

carbon 0.4 wt %
silicon 0.7 wt %
manganese 1.32 wt %
copper 0.06 wt %
chromium 0.19 wt %
nitrogen 0.015 wt %

The main component of the microalloy is iron.

Arc wire spraying with a wire-form spray material 4 formed from these microalloys gives rise to a particularly uniform coating 2 with low porosity and low roughness.

The low carbon content and the elevated manganese content and the elevated silicon content of the microalloy result in improved spraying performance, which is characterized in that small, uniform, viscous droplets arise during the arc wire spraying. Owing to their viscosity, these droplets only break down to a slight extent into finer particles during flight and upon spattering and therefore tend to oxidize to a lesser extent. Less surface oxidation enhances the adhesion of the particles to the substrate (coating adhesion) and the adhesion of the particles to one another (coating cohesion).

The elevated manganese content furthermore leads to a predominantly pearlitic/bainitic structure as the spray coating 2 solidifies.

The addition of copper improves the corrosion resistance of the coating 2.

The nitrogen supplement enhances the formation of wear-resistant nitrides, which are also tribologically effective in terms of friction coefficient reduction.

Fine-grained pearlite and bainite as well as wear-resistant martensite islands form upon the solidification of the coating 2. Bainite is a durable intermediate stage structure of carbon-containing steels. Pearlite is a mixed structure consisting of soft ferritic and hard carbide phases. The formation of bainite and pearlite can be influenced by spraying parameters, the type of cooling of the spray material, and by the selection of the alloy components of the microalloy. The coating 2 is configured in the form of a soft, ductile matrix of pearlite and bainite with hard, wear-resistant islands of martensite.

The wire-form spray material 4 is preferably hot rolled and/or hot drawn and then cooled and/or soft-annealed slowly and in a controlled manner in a stove in order to obtain a ductile structure so that the wire-form spray material 4 remains flexible.

The alloy components of the wire are measured so as to take the burn-off of certain elements, e.g., carbon, into account. The alloy composition of the coating 2 is altered in accordance with the burn-off. The wire composition is adapted to the target properties of the sprayed coating.

A surface of the wire-form spray material 4 is preferably provided with a copper plating in order to prevent corrosion.

The wire is low alloy, wherein the selection is specifically oriented to cost-effective alloy elements.

The resulting spray coating exhibits good machinability and improved tribologic properties as well as good wear resistance.

LIST OF REFERENCE SIGNS

1 Substrate
2 Coating
3 Coating head
4 Wire-form spray material
5 Electric arc

The invention claimed is:

1. A wire-form spray material (4) in the form of a solid wire base body, with an optional plating layer, wherein the solid wire base body is formed at least with carbon as a microalloy such that pearlite, bainite, and martensite form upon solidification of the spray material, and wherein the solid wire base body comprises the following alloy components:

carbon 0.28 wt % to 0.6 wt %,
silicon 0.6 wt % to 0.8 wt %,
manganese 1.0 wt % to 1.4 wt %,
chromium 0.05 wt % to 0.35 wt %,
copper 0.04 wt % to 0.15 wt %,
nitrogen 0.005 wt % to 0.03 wt %, and optionally elective components selected from vanadium, nickel, molybdenum, phosphorus, sulfur, and aluminum, with the remainder iron and unavoidable impurities, based on a total weight of solid wire base body in each case.

2. The wire-form spray material (4) as in claim 1, comprising vanadium with a fraction of up to 0.15 wt %, nickel with a fraction of up to 0.1 wt %, molybdenum with a fraction of up to 0.03 wt %; phosphorus, sulfur, and aluminum with a fraction of up to 0.01 wt %, based on a total weight in each case.

3. A wire-form spray material (4) wherein the spray material (4) is formed at least with carbon as a microalloy such that pearlite, bainite, and martensite form upon solidification of the spray material, and wherein the spray material comprises the following alloy components:

carbon 0.28 wt % to 0.6 wt %,
silicon 0.6 wt % to 0.8 wt %,
manganese 1.0 wt % to 1.4 wt %,
chromium 0.05 wt % to 0.35 wt %,
copper 0.04 wt % to 0.15 wt %,
nitrogen 0.005 wt % to 0.03 wt %, wherein a surface of the spray material (4) is provided with a copper plating.

4. An iron-based thermal sprayed coating on a substrate, the iron-based thermal sprayed coating having a predominantly pearlitic/bainitic structure and comprising the following alloy components:

carbon 0.28 wt % to 0.6 wt %,
silicon 0.6 wt % to 0.8 wt %,
manganese 1.0 wt % to 1.4 w t%,
chromium 0.05 to 0.35 wt %,
copper 0.04 wt % to 0.15 wt %,
nitrogen 0.005 to 0.03 wt %, and optionally components selected from vanadium, nickel, molybdenum, phosphorus, sulfur, and aluminum, with the remainder iron and unavoidable impurities, based on a total weight in each case.

5. The thermal sprayed coating as in claim 4, wherein the substrate is an engine block of a reciprocating piston engine, and wherein the coating was sprayed in the inside of the engine block to form a contact layer.

* * * * *